US005929557A

United States Patent [19]

Makishima et al.

[11] Patent Number: 5,929,557

[45] Date of Patent: Jul. 27, 1999

[54] FIELD-EMISSION CATHODE CAPABLE OF FORMING AN ELECTRON BEAM HAVING A HIGH CURRENT DENSITY AND A LOW RIPPLE

[75] Inventors: Hideo Makishima; Masaaki Takahashi, both of Tokyo, Japan

[73] Assignee: NEC Corporation, Tokyo, Japan

[21] Appl. No.: 08/962,874

[22] Filed: Nov. 3, 1997

[30] Foreign Application Priority Data

Nov. 1, 1996 [JP] Japan ..... 8-291453

[51] Int. Cl.[6] ..... H01J 1/02

[52] U.S. Cl. ..... 313/309; 313/336; 313/351

[58] Field of Search ..... 313/309, 351, 313/336, 495, 494

[56] References Cited

U.S. PATENT DOCUMENTS

| | | | |
|---|---|---|---|
| 3,596,131 | 7/1971 | Wilczek | 315/39.3 |
| 4,818,914 | 4/1989 | Brodie | 315/169.3 |
| 5,281,891 | 1/1994 | Kaneko et al. | 313/309 |
| 5,336,973 | 8/1994 | Leroux et al. | 315/14 |
| 5,504,390 | 4/1996 | Topp | 313/509 |
| 5,583,393 | 12/1996 | Jones | 313/495 |
| 5,635,791 | 6/1997 | Vickers | 313/309 |
| 5,644,187 | 7/1997 | Jaskie et al. | 313/293 |
| 5,757,138 | 5/1998 | Tsai | 315/169.3 |

FOREIGN PATENT DOCUMENTS

| | | |
|---|---|---|
| 0564926 | 10/1993 | European Pat. Off. . |
| 5-307930 | 11/1993 | Japan . |
| 6-243777 | 9/1994 | Japan . |
| 7-14501 | 1/1995 | Japan . |

OTHER PUBLICATIONS

C.A. Spindt, "A Thin–Film Field–Emission Cathode", *J. Applied Physics*, vol. 39, No. 7, Jun. 1968, pp. 3504–3505.

Armand Staprans et al., "High–Power Linear–Beam Tubes", *Proceedings of the IEEE*, vol. 61, No. 3, Mar. 1973, pp. 299–301.

Patent Abstracts of Japan, vol. 018, No. 623 (E–1635), Nov. 28, 1994.

*Primary Examiner*—Sandra O'Shea
*Assistant Examiner*—Michael J. Smith
*Attorney, Agent, or Firm*—Sughrue, Mion, Zinn, Macpeak & Seas, PLLC

[57] ABSTRACT

A field-emission cold cathode has a conductive cold-cathode substrate on which a plurality of conical emitters and a base insulator layer are formed. A ring-shaped gate electrode, a plate-shaped inner electrode, and a ring-shaped outer electrode are formed on the base insulator layer with the ring-shaped gate electrode disposed between the plate-shaped inner electrode and the ring-shaped outer electrode. A voltage supplying unit supplies the ring-shaped gate electrode, the plate-shaped inner electrode, and the ring-shaped outer electrode with a gate voltage, an inner electrode voltage, and an outer electrode voltage, each referenced to a substrate potential of the conductive cold-cathode substrate, wherein the gate voltage is higher than each of the inner electrode voltage and the outer electrode voltage.

9 Claims, 11 Drawing Sheets

FIELD-EMISSION CATHODE CAPABLE OF FORMING AN ELECTRON BEAM HAVING A HIGH CURRENT DENSITY AND A LOW RIPPLE

BACKGROUND OF THE INVENTION

1. Field of the Invention

This invention relates to a field-emission cold-cathode electron gun for forming an electron beam using a cold cathode of a field emitter array (FEA) type having a fine structure fabricated by thin film technology, and to a microwave tube including the cold-cathode electron gun, such as a traveling-wave tube (TWT) or a klystron.

2. History of the Prior Art

A field-emission cold cathode is disclosed in an article by C. A. Spindt, Journal of Applied Physics, Vol. 39, No. 7 (June 1968), pages 3504–3505, entitled "A Thin-Film Field-Emission Cathode." The field-emission cold cathode comprises a plurality of minute cold cathodes in an array fashion. Each minute cold cathode comprises a minute conical emitter (an electron emission electrode) and a gate electrode (a control electrode) formed in the vicinity of the emitter for extracting electrons from the emitter and for controlling the flow of the electrons. Such a field-emission cold cathode is called a Spindt-type cold cathode. It is desirable to use the field-emission cold cathode in a microwave tube such as a traveling-wave tube (TWT) or a klystron. This is because the microwave tube may be miniaturized due to the cathode not requiring a heater. However, in a case where the Spindt-type cold cathode is installed in an electron beam apparatus such as a microwave tube, there may be two problems: 1) electrons having a lateral velocity component, and 2) failure to meet the design conditions of a Pierce electron gun.

In order to resolve the first problem, a known method is to deposit a focusing electrode on the gate electrode to suppress the lateral velocity component. However, this method cannot suppress a ripple of the electron beam.

In order to resolve the second problem, another conventional field-emission cold cathode is disclosed in Japanese Unexamined Patent Publication of Tokkai No. Hei 7-14,501 or JP-A 7-14,501. The field-emission cold cathode according to JP-A 7-14,501 further comprises a peripheral electrode. However, this cathode cannot sufficiently suppress the lateral velocity component or completely suppress the ripple of the electron beam.

Another conventional hot-cathode electron gun is disclosed in an article by A. Starrans, et. al., PROCEEDING OF THE IEEE, VOL. 61, NO. 3 (MARCH 1973), pages 299–301, entitled "High-Power Linear-Beam Tubes." This hot-cathode electron gun comprises a ring-shaped hot cathode, a central beam control electrode, a cylindrical beam control electrode, and an anode. However, this hot-cathode electron gun cannot control the amount of current of the electron beam.

Another conventional field-emission cold cathode is disclosed in Japanese Unexamined Patent Publication of Tokkai No. Hei 5-307,930, namely, JP-A 5-307,930. This field-emission cold cathode includes a metal in a central part without forming any minute cold cathode. However, this field-emission cold cathode cannot suppress the lateral velocity component.

Another conventional field-emission cold cathode is disclosed in Japanese Unexamined Patent Publication of Tokkai No. Hei 6-243,777 or JP-A 6-234,777. This field-emission cold cathode includes a shielding electrode kept apart from a plurality of ring-shaped gate electrodes by ring-shaped grooves. The shielding electrode is supplied with a shielding voltage while each ring-shaped gate electrode is supplied with a gate electrode voltage not higher than the shielding voltage. However, this field-emission cold cathode cannot suppress the lateral velocity component.

SUMMARY OF THE INVENTION

It is, therefore, an object of this invention to provide a cold-cathode electron gun capable of forming an electron beam having a high current density and having a low ripple. It is another object of this invention to provide a cold-cathode electron gun capable of allowing a cold cathode to be used under any conditions. Other objects of this invention will become clear from the following description.

According to a first aspect of this invention, a field-emission cold cathode is used in an electron gun for radiating an electron beam therefrom along a central axis in a forward direction. The field-emission cold cathode comprises a conductive cold-cathode substrate which has a substrate center concentric with the central axis and which has a principal surface perpendicular to the central axis. The conductive cold-cathode substrate is supplied with a substrate potential. A plurality of conical emitters are formed on the principal surface of the conductive cold-cathode substrate in a ring-shaped emitter region around the substrate center. Each conical emitter has a tip from which electrons emit in the forward direction. A base insulator layer is formed on the principal surface of the cold-cathode substrate. The base insulator layer has a plurality of base-insulator holes surrounding the respective conical emitters with spacers left therebetween. A ring-shaped gate electrode is formed on the base insulator layer in a ring-shaped gate region opposed to the ring-shaped emitter region through the base insulator layer. The ring-shaped gate electrode has a gate center concentric with the central axis and has a plurality of gate holes which communicate with the respective base-insulator holes of the base insulator layer so as to surround the conical emitters. The ring-shaped gate electrode is for extracting the electrons emitted from the conical emitters to make the electrons radiate as the electron beam. A plate-shaped inner electrode is formed on the base insulator layer in an inner region enclosed by the ring-shaped gate electrode, with a ring-shaped inner space left therebetween. A ring-shaped outer electrode is formed on the base insulator layer in an outer region surrounding the ring-shaped gate electrode, with a ring-shaped outer space left therebetween. A voltage supplying unit supplies the ring-shaped gate electrode, the plate-shaped inner electrode, and the ring-shaped outer electrode with a gate voltage, an inner-electrode voltage, and an outer-electrode voltage based on the substrate potential of the conductive cold-cathode substrate, respectively. The gate voltage is higher than the inner-electrode voltage and the gate voltage is higher than the outer-electrode voltage.

According to a second aspect of this invention, a field-emission cold cathode in an electron gun radiates an electron beam therefrom along a central axis in a forward direction. The field-emission cold cathode comprises a conductive cold-cathode substrate which has a substrate center concentric with the central axis and which has a principal surface perpendicular to the central axis. The conductive cold-cathode substrate is supplied with a substrate potential. A plurality of conical emitters are formed on the principal surface of the conductive cold-cathode substrate in a ring-shaped emitter region around the substrate center. Each conical emitter has a tip from which electrons emit in the forward direction. A base insulator layer is formed on the principal surface of the cold-cathode substrate. The base insulator layer has a plurality of base-insulator holes surrounding the respective conical emitters with spacers left therebetween. A gate electrode is formed on the base insulator layer. The gate electrode has a gate center concentric with the central axis and has a plurality of gate holes which are aligned with the respective base-insulator holes of the base insulator layer so as to surround the conical emitters. The gate electrode is for extracting the electrons emitted from the conical emitters to make the electrons radiate as the electron beam. An upper insulator layer is formed on the gate electrode. The upper insulator layer has a plurality of upper-insulator holes which align with the base-insulator holes via the gate holes. A ring-shaped focusing electrode is formed on the upper insulator layer in a ring-shaped focusing region opposing the ring-shaped emitter region through the upper insulator layer and the gate electrode. The ring-shaped focusing electrode has a focusing center concentric with the central axis and has a plurality of focusing holes which align with the respective gate holes via the upper-insulator holes. A plate-shaped inner electrode is formed on the upper insulator layer in an inner region enclosed by the ring-shaped focusing electrode with a ring-shaped inner space left therebetween. A ring-shaped outer electrode is formed on the upper insulator layer in an outer region surrounding the ring-shaped focusing electrode with a ring-shaped outer space left therebetween. A voltage supplying unit supplies the ring-shaped focusing electrode, the plate-shaped inner electrode, and the ring-shaped outer electrode with a focusing voltage, an inner-electrode voltage, and an outer-electrode voltage based on the substrate potential of the conductive cold-cathode substrate, respectively. The focusing voltage is higher than the inner-electrode voltage and the focusing voltage is higher than the outer-electrode voltage.

According to a third aspect of this invention, a cold-cathode electron gun radiates an electron beam therefrom along a central axis in a forward direction. The cold-cathode electron gun comprises a ring-shaped cold cathode having a cathode opening coaxial with the central axis. The ring-shaped cold cathode emits electrons along the central axis to make the electrons radiate as the electron beam. The ring-shaped cold cathode includes a conductive cathode substrate supplied with a substrate potential and a ring-shaped gate electrode. The ring-shaped cold cathode has electron emission region. A cylindrical outer Wehnelt electrode surrounds the ring-shaped cold cathode with a ring-shaped outer space left therebetween. The cylindrical outer Wehnelt electrode extends in the forward direction from the ring-shaped cold cathode. A rod-shaped inner Wehnelt electrode is surrounded by the ring-shaped cold cathode, with a ring-shaped inner space left therebetween. The rod-shaped inner Wehnelt electrode extends in the forward direction from the ring-shaped cold cathode. A voltage supplying unit supplies the ring-shaped gate electrode of the ring-shaped cold cathode, the cylindrical outer Wehnelt electrode, and the rod-shaped inner Wehnelt electrode with a gate voltage, an outer Wehnelt voltage, and an inner Wehnelt voltage based on the substrate potential. The gate voltage is higher than the outer Wehnelt voltage and the gate voltage is higher than the inner Wehnelt voltage.

DETAILED DESCRIPTION OF THE DRAWINGS

Figure 1:
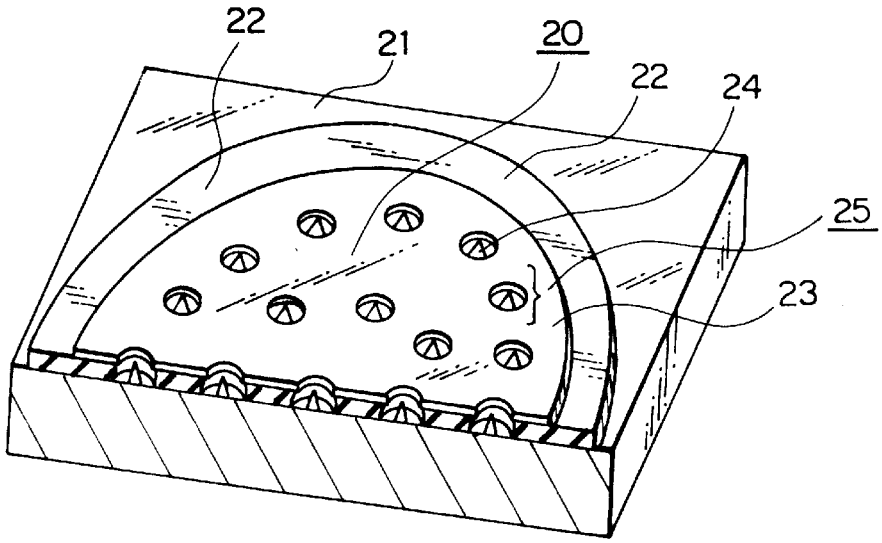
FIG. 1 PRIOR ART
FIG. 1 is a perspective cross-sectional view showing a first conventional field-emission cold cathode.
Figure 2:
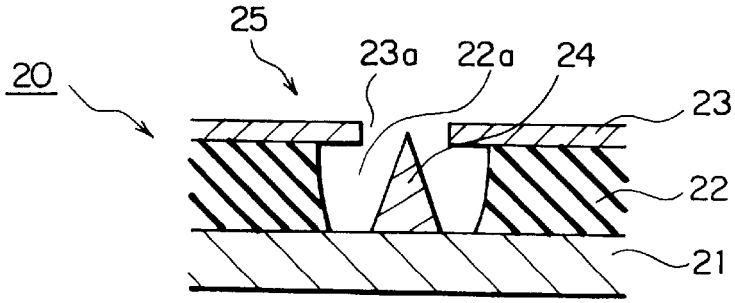
FIG. 2 PRIOR ART
FIG. 2 is a fragmentary vertical sectional view of a minute cold cathode for use in the field-emission cold cathode illustrated in FIG. 1.

Referring to FIGS. 1 and 2, a first conventional field-emission cold cathode will first be described in order to facilitate an understanding of the present invention. The illustrated field-emission cold cathode is disclosed in an article by C. A. Spindt in Journal of Applied Physics, Vol. 39, No. 7 (June 1968), pages 3504–3505, entitled "A Thin-Film Field-Emission Cathode." FIG. 1 is a perspective cross-sectional view showing the structure of the field-emission cold cathode and FIG. 2 is a fragmentary vertical sectional view of a minute cold cathode section of the field-emission cold cathode.

The field-emission cold cathode 20 comprises a silicon substrate 21, a base insulator layer 22 formed on the silicon substrate 21 and made of silicon dioxide, and a gate electrode 23 formed on the base insulator layer 22. The base insulator layer 22 and the gate electrode 23 are selectively removed to form a plurality of caves. In other words, the base insulator layer 22 has a plurality of base insulator holes 22*a* while the gate electrode 23 has a plurality of gate holes 23*a* which align with the respective base insulator holes 22*a*. Each cave is composed of the base insulator hole 22*a* and the gate hole 23*a*. On the silicon substrate 21, a plurality of conical emitters 24 are formed in an array fashion. The conical emitters 24 are received in the respective caves. A combination of one conical emitter 24 and the gate electrode 23 represents the minute cold cathode 25. A plurality of minute cold cathodes 25 are arranged in the array fashion to compose the field-emission cold cathode 20 having a plane electron emission region.

Each conical emitter 24 emits electrons and is therefore called an electron emission electrode. Formed in the vicinity of the conical emitters 24, the gate electrode 23 extracts the electrons from the conical emitters 24 and controls the flow of the electrons extracted from the conical emitters 24, and is therefore referred to as a control electrode.

As shown in FIGS. 1 and 2, the silicon substrate 21 is electrically connected to the conical emitters 24. Between each conical emitter 24 and the gate electrode 23, a voltage of about fifty volts is applied. The base insulator layer 22 has a thickness of about one micron and each gate hole 23*a* has a diameter of about one micron. Each conical emitter 24 has an acute tip having a size of about ten nanometers. As a result, the acute tip of each conical emitter 24 is applied with a strong electric field. When the electric field is not less than $2–5\times10^7$ V/cm, the electrons are emitted from the acute tip of each conical emitter 24. By arranging the above-mentioned minute cold cathodes 25 on the silicon substrate 21, a flat-type field emitter array (FEA) for emitting a large amount of electron is constructed. In addition, if the minute cold cathodes 25 are arranged in high density using a fine processing technique, it is possible to realize a field-emission cold cathode having a high cathode current density, five to ten times that of a conventional hot thermionic cathode.

The field-emission cold cathode described above is called a Spindt-type cold cathode. The Spindt-type cold cathode has a high cathode current density compared with a hot cathode and is advantageous in that it has little velocity dispersion for emitted electrons. In addition, the Spindt-type cold cathode has current noise having a low level compared with a single field-emission emitter, and is operable at a low voltage of about ten volts to several tens of volts. The Spindt-type cold cathode is operable in an environment with a relatively low degree of vacuum.

By applying this cold cathode to microwave tubes such as a traveling-wave tube (TWT) or a klystron, it is possible to realize an amplification apparatus having a high efficiency in a high frequency range. This is because the cold cathode is a low consumption electrode due to no cathode heating requirement, and because the cold cathode outputs high power due to high cathode current density. In addition, because it is unnecessary to heat the cathode, it is possible to miniaturize the microwave tube, in particular for implementing an electron gun in a microwave tube.

However, in a case where this cold cathode is installed in an electron beam apparatus such as a microwave tube, the following two problems can arise:

1) Some electrons among electrons emitted from the cathode can have a lateral velocity component because the electrons are influenced by a strongly distorted distribution of the electric field about the tip of individual emitter.
2) Design conditions of a Pierce electron gun are not satisfied because the cold cathode is formed on a plane and has a plane electron emission region.

It is therefore impossible with this conventional cold cathode to realize a strong interaction between an electron beam and a microwave due to a ripple of the electron beam, and high gain and efficiency cannot be realized. In addition, when the ripple of the electron beam is large, a part of the electron beam flows into a slow wave structure such as a helix and degradation of reliability may occur because the degree of vacuum in the tube becomes low. As a result, although this conventional cold cathode is operable with a high cathode current density, it is impossible to make the most of this advantage and it has not been optimized in improving the performance of the microwave tube.

Figure 3:
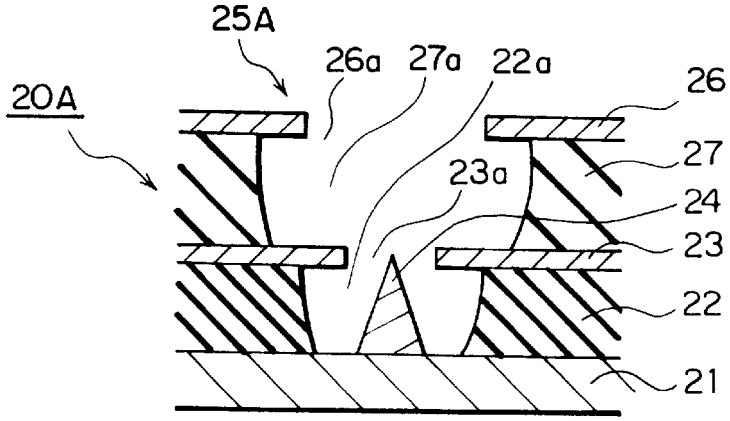
FIG. 3 PRIOR ART
FIG. 3 is a fragmentary vertical sectional view of a minute cold cathode for use in a second conventional field-emission cold cathode.

Under the circumstances, in order to resolve the above-mentioned problem 1), a method for suppressing the lateral velocity component is achieved by a second conventional field-emission cold cathode 20A, illustrated in FIG. 3.

FIG. 3 is a fragmentary vertical sectional view of minute cold cathode 25A, where the minute cold cathode 25 is modified. The minute cold cathode 25A comprises not only the gate electrode 23 and the conical emitter 24 but also a focusing electrode 26 deposited on the gate electrode 23 through an upper insulator layer 27. The upper insulator layer 27 has a plurality of upper insulator holes 27*a* and the focusing electrode 26 has a plurality of focusing holes 26*a*. The upper-insulator holes 27*a* and the focusing holes 26*a* align with the respective gate holes 23. Emitted from the conical emitter 24, the electrons are focused by the focusing electrode 26.

However, the second conventional field-emission cold cathode 20A with the focusing electrode 26 cannot suppress the ripple of the electron beam (in the above-mentioned problem 2)), although it may suppress the lateral velocity component in the electron beam emitted from the individual emitter. As a result, it is not possible to reliably form a sufficiently good electron beam. In addition, it is necessary to set a potential of the focusing electrode 26 to a value near to an emitter potential to realize a sufficient focusing effect by the focusing electrode 26. As a result, the problems of a withstand voltage between the gate electrode 23 and the focusing electrode 26, an emission suppression effect due to the focusing electrode 26, and so on, arise.

Figure 4:
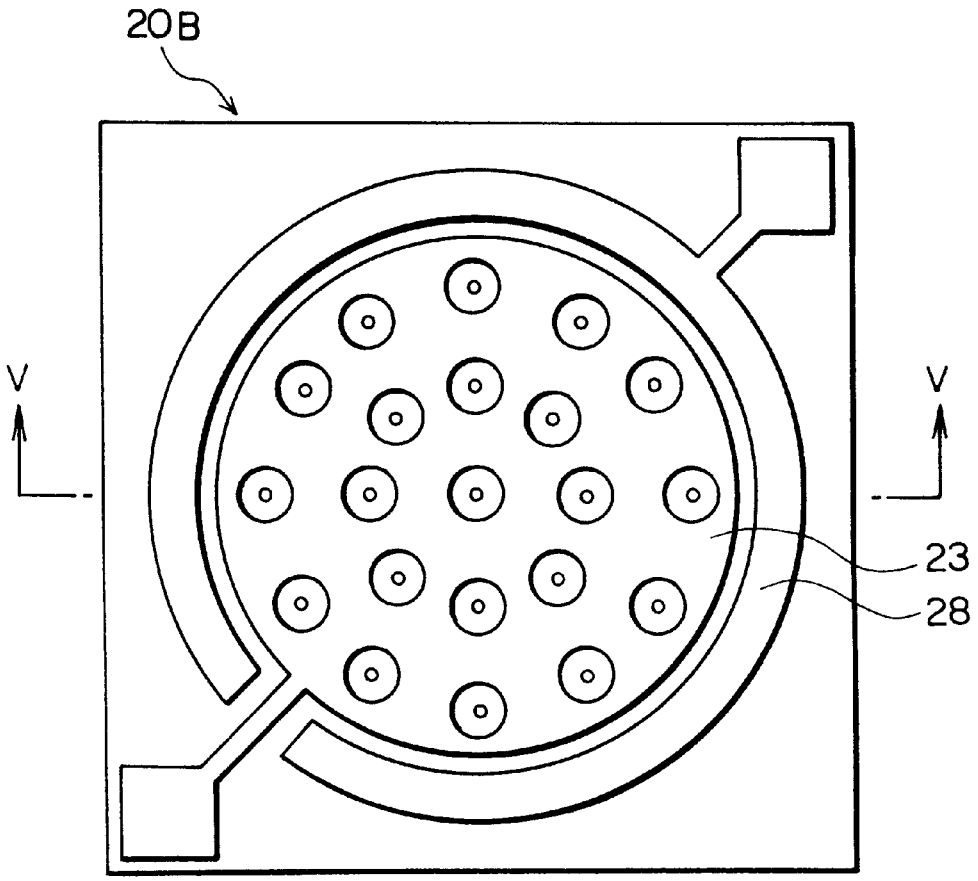
FIG. 4 PRIOR ART
FIG. 4 is a plan view showing a third conventional field-emission cold cathode.
Figure 5:
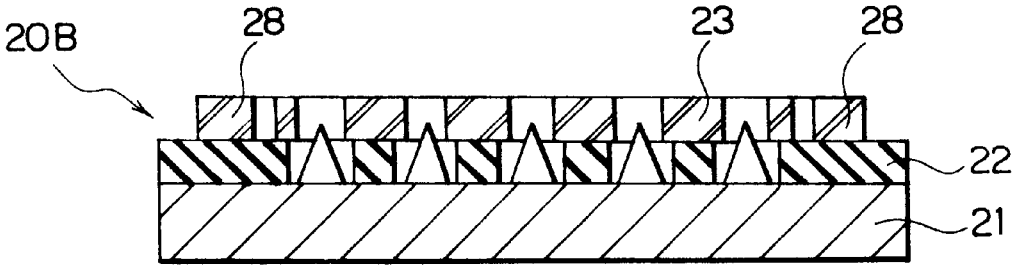
FIG. 5 PRIOR ART
FIG. 5 is a cross-sectional view taken on line V—V of FIG. 4.

In order to resolve the above-mentioned problem 2), a third conventional field-emission cold cathode 20B, illustrated in FIGS. 4 and 5, is disclosed in Japanese Unexamined Patent Publication of Tokkai No. Hei 7-4,501 or JP-A 7-4,501. FIG. 4 is a plan view showing the structure of the third conventional field-emission cold cathode and FIG. 5 is a cross-sectional view taken on line V—V of FIG. 4.

As shown in FIGS. 4 and 5, the third conventional field-emission cold cathode 20B comprises not only the silicon substrate 21, the base insulator layer 22 formed on the silicon substrate 21, and the gate electrode 23 formed on the base insulator layer 22, but also includes a peripheral electrode 28 formed on the base insulator layer 22 so as to surround the gate electrode 23. The peripheral electrode 28 may be applied with a voltage which is different from that applied to the gate electrode 23. With this structure, it is possible to fine adjust a focusing condition in the electron beam, with an axial symmetry of a potential in a cathode circumferential section maintained in a proper range.

However, in structure shown in FIGS. 4 and 5, it is impossible to sufficiently suppress the lateral velocity component of the above-mentioned problem 1) and to completely suppress the ripple of the electron beam in the above-mentioned problem 2).

Figure 6:
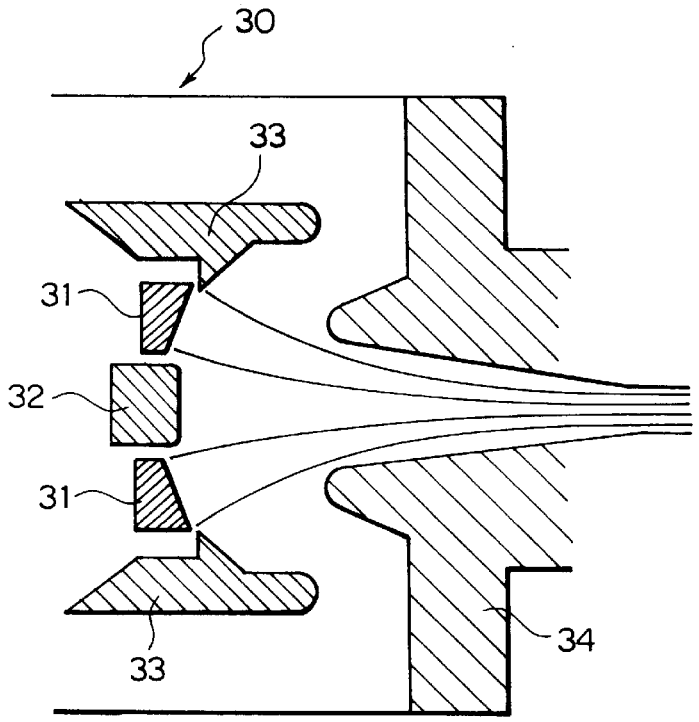
FIG. 6 PRIOR ART
FIG. 6 is a schematic longitudinal sectional view showing a conventional hot-cathode electron gun.

Referring to FIG. 6, a conventional hot-cathode electron gun will be described in order to facilitate an understanding of the present invention. The illustrated hot-cathode electron gun is disclosed in an article by A. Staprans, et al. in PROCEEDING OF THE IEEE, VOL. 61, NO. 3 (MARCH 1973), pages 299–301, entitled "High-Power Linear-Beam Tubes." FIG. 6 is a schematic longitudinal sectional view showing the structure of the hot-cathode electron gun.

The hot-cathode electron gun 30 comprises a ring-shaped hot cathode 31 having a cathode hole 31*a* at a center thereof, a central beam control electrode 32 surrounded by the ring-shaped hot cathode 31, a cylindrical beam control electrode 33 surrounding the ring-shaped hot cathode 31, and an anode 34 opposing the ring-shaped hot cathode 31. The central beam control electrode 32 and the cylindrical beam control electrode 33 are supplied with a control voltage, and an on-off for an electron beam is carried out by changing the control voltage. This hot-cathode electron gun 30 focuses the electron beam, in terms of distribution of an electric field, near to the Pierce electron gun when it is put into an on state. However, the illustrated hot-cathode electron gun 30 cannot be used to control the amount of current of the electron beam. This is because a focusing state of the electron beam changes when the control voltage applied with the beam control electrodes 32 and 33 is changed.

Figure 7:
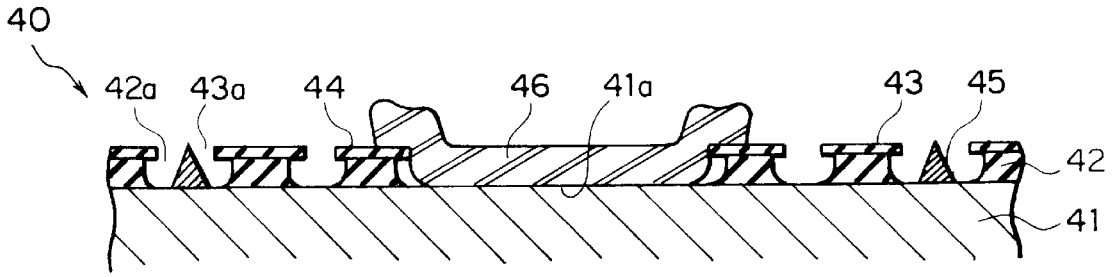
FIG. 7 PRIOR ART
FIG. 7 is a cross-sectional view of a fourth conventional field-emission cold cathode.
Figure 8:
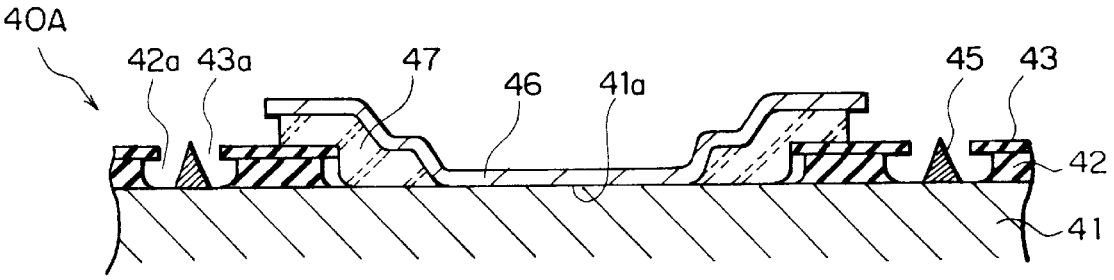
FIG. 8 PRIOR ART
FIG. 8 is a cross-sectional view of a fifth conventional field-emission cold cathode.

Referring to FIGS. 7 and 8, the fourth and fifth conventional field-emission cold cathodes 40 and 40A, disclosed in Japanese Unexamined Patent Publication of Tokkai No. Hei 5-307,930 or JP-A 5-307,930, will be described.

As shown in FIG. 7, the fourth conventional field-emission cold cathode 40 comprises a semiconductor substrate 41 having a central part 41*a*, an ring-shaped insulator layer 42 formed on the semiconductor substrate 41 at a region other than the central part 41*a*, a ring-shaped gate electrode 43 and a gate ring 44 formed on the insulator layer 42. The gate ring 44 is made of the same material as the ring-shaped gate electrode 43 and surrounds the central part 41*a*. In addition, the gate ring 44 is electrically isolated from the ring-shaped gate electrode 43. The ring-shaped insulator layer 42 has a plurality of insulator holes 42*a* and the ring-shaped gate electrode 43 has a plurality of gate holes 43*a* which align with the respective insulator holes 42*a*. A combination of one insulator hole 42*a* and the corresponding gate hole 43*a* is called a cave. On the semiconductor substrate 41, a plurality of conical emitters 45 are formed in an array fashion. The conical emitters 45 are surrounded with the respective caves. A combination of one conical emitter 45 and the gate electrode 43 serves as a minute cold cathode.

The fourth conventional field-emission cold cathode 40 further comprises a metal layer 46 formed on the semiconductor substrate 41 at the central part 41*a* and on the gate ring 44.

Turning to FIG. 8, the fifth conventional field-emission cold cathode 40A is similar in structure to the fourth conventional field-emission cold cathode 40 illustrated in FIG. 7, except that the fifth conventional field-emission cold cathode 40A comprises an ring-shaped insulator layer 47 in place of the ring-shaped gate electrode 43. The ring-shaped insulator layer 47 is formed on the semiconductor substrate 41 so as to surround the central part 41*a* and is formed on the ring-shaped gate electrode 43 at the inside edge. The metal layer 46 is formed on the semiconductor substrate 41 at the central part 41*a* and on the ring-shaped insulator layer 47.

In the fourth and the fifth conventional field-emission cold cathodes 40 and 40A, a metal layer 46 having higher sputtering resistance is formed on the semiconductor substrate 41 at the central part 41*a* without forming any minute cold cathode. As is well known in the art, a microwave tube comprises a slow-wave structure having an axisymmetric electromagnetic field. To the extent that gas remains in the helix slow-wave circuit, the gas is ionized by colliding with the electron beam to generate positive ions in the helix slow-wave circuit. The positive ions are accelerated in the opposite direction to the flow of the electron beam and finally collide with the field-emission cold cathode at the central part 41*a*. Because the positive ions collide with the metal layer 46, it is possible to prevent the positive ions from colliding with any minute cold cathode. In addition, it is possible to prevent the cold cathode from being inoperable due to short-circuiting between the gate electrode 43 and the conical emitters 45. However, in these conventional cold cathode structures, it is impossible to suppress the lateral velocity component as described in the above-mentioned problem 1).

Figure 9:
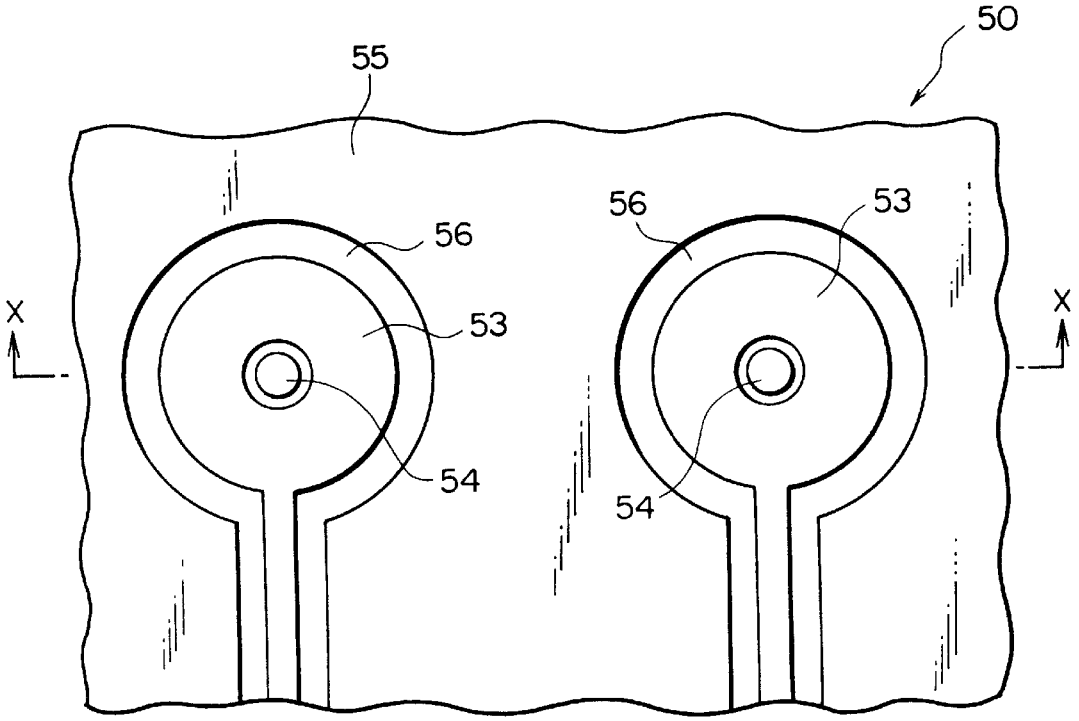
FIG. 9 PRIOR ART
FIG. 9 is a plan view showing a sixth conventional field-emission cold cathode.
Figure 10:
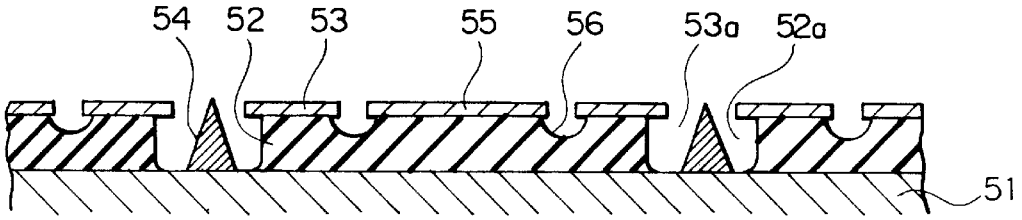
FIG. 10 PRIOR ART
FIG. 10 is a cross-sectional view taken on line X—X of FIG. 9.

Referring to FIGS. 9 and 10, a sixth conventional field-emission cold cathode 50, disclosed in Japanese Unexamined Patent Publication of Tokkai No. Hei 6-243,777 or JP-A6-243,777, will be described. FIG. 9 is a plan view showing a structure of the sixth conventional field-emission cold cathode and FIG. 10 is a cross-sectional view taken on line X—X of FIG. 9.

The sixth conventional field-emission cold cathode 50 comprises a semiconductor substrate 51, an insulator layer 52 formed on the semiconductor substrate 51, and a plurality of ring-shaped gate electrodes 53 formed on the insulator layer 52. The insulator layer 52 has a plurality of insulator holes 52*a* and each ring-shaped gate electrode 53 has a gate hole 53*a* which aligns with a corresponding insulator hole 52*a*. A combination of one insulator hole 52*a* and the corresponding gate hole 53*a* is called a cave. On the semiconductor substrate 51, a plurality of conical emitters 54 are formed in an array fashion. The conical emitters 54 are surrounded with the respective caves. A combination of one conical emitter 54 and the corresponding ring-shaped gate electrode 53 defines a minute cold cathode. A plurality of minute cold cathodes are separated from each other.

The sixth conventional field-emission cold cathode 50 further comprises a shielding electrode 55 formed on the semiconductor substrate 51 and kept apart from the ring-shaped gate electrodes 53 by the ring-shaped grooves 56. The ring-shaped grooves 56 are parts of the insulator layer 52. The shielding electrode 55 is always applied with a shielding voltage which is fixed, for example, at 100 volts on the basis of the conical emitters 54. Each ring-shaped gate electrode 53 is applied with a control voltage or a gate voltage via a proper wiring. The gate voltage varies between 0–100 volts, with respect to the conical emitters 54, so as to vary an amount of electrons emitted from the conical emitters 54. That is, the gate voltage is not higher than the shielding voltage.

With this structure, it is possible to prevent adjacent conical emitters 54 from affecting each other. However, it is impossible to suppress the lateral velocity component described in the above-mentioned problem 1).

DESCRIPTION OF THE PREFERRED EMBODIMENTS

Figure 11:
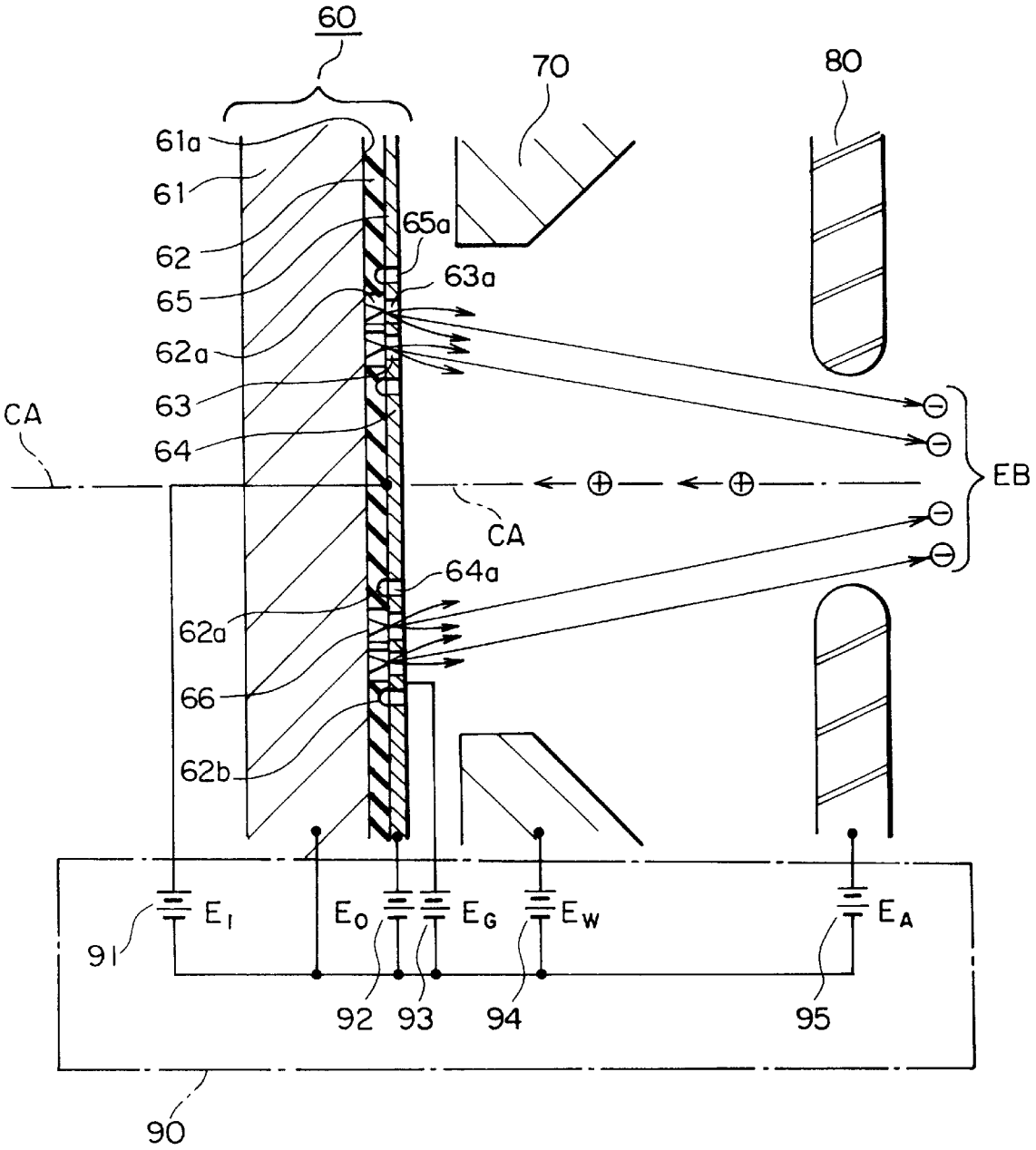
FIG. 11 is a schematic longitudinal sectional view showing a cold-cathode electron gun according to a first embodiment of the invention.

Referring to FIG. 11, a cold-cathode electron gun according to a first embodiment of this invention will be described. FIG. 11 is a schematic longitudinal sectional view showing the structure of the cold-cathode electron gun. The cold-cathode electron gun radiates an electron beam EB therefrom along a central axis CA in the forward direction (rightward in FIG. 11).

The illustrated cold-cathode electron gun comprises a field-emission cold cathode 60 for emitting free electrons in a vacuum, a Wehnelt electrode 70 for focusing the free electrons around the central axis CA, an anode 80 for accelerating the free electrons to form the electron beam EB, and a voltage supplying unit 90 for supplying the field emission cold cathode 60, the Wehnelt electrode 70, and the anode 80 with voltages which will be described hereinafter. The whole of the cold-cathode electron gun is accommodated in a vacuum vessel (not shown).

Figure 12:
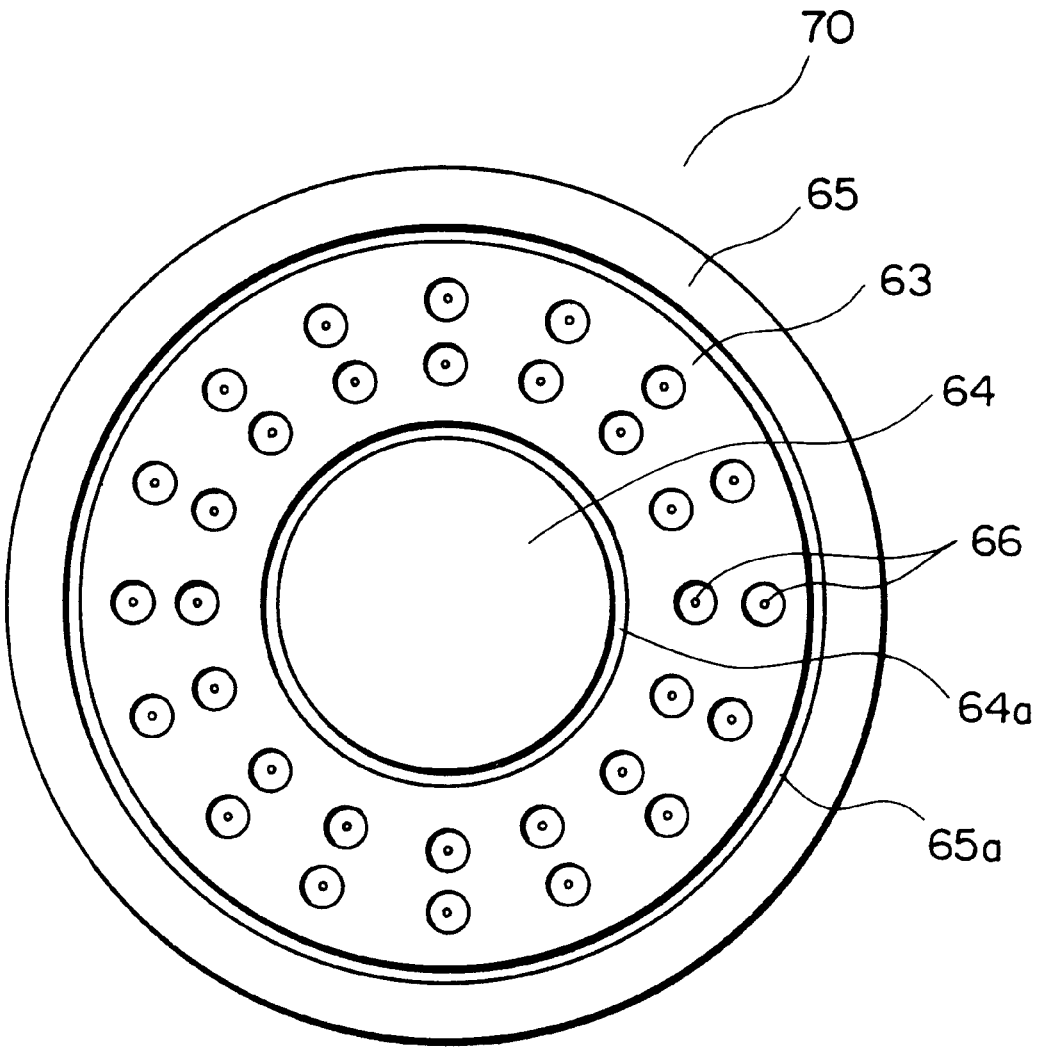
FIG. 12 is a plan view of the cold-cathode electron gun illustrated in FIG. 11.

Referring to FIGS. 11 and 12, the field-emission cold cathode 60 comprises a conductive cold-cathode substrate 61, a base insulator layer 62, a ring-shaped gate electrode 63, a plate-shaped inner electrode 64, a ring-shaped outer electrode 65, and a plurality of conical emitters 66.

The conductive cold-cathode substrate 61 has a substrate center concentric with the central axis CA and a principal surface 61*a* perpendicular to the central axis CA. The conductive cold-cathode substrate 61 is supplied with a substrate potential from the voltage supplying unit 90. The conical emitters 66 are formed on the principal surface 61*a* of the conductive cold-cathode substrate 61 in a ring-shaped emitter region around the substrate center. Each conical emitter 66 has a tip from which the electrons emit in the forward direction. That is, each conical emitter 66 acts as an electron emission electrode.

The base insulator layer 62 is formed on the principal surface 61*a* of the cold-cathode substrate 61. The base insulator layer 62 has a plurality of base insulator holes 62*a* which surround the conical emitters 66 with spacers left therebetween.

The ring-shaped gate electrode 63 is formed on the base insulator layer 62 in a ring-shaped gate region which opposes the ring-shaped emitter region through the base insulator layer 62. The ring-shaped gate electrode 63 has a gate center concentric with the central axis CA. The ring-shaped electrode 63 has a plurality of gate holes 63*a* which align with the respective base insulator holes 62*a* of the base insulator layer 62 so as to surround the conical emitters 66. The ring-shaped gate electrode 63 extracts the electrons emitted from the conical emitters 66 to make the electrons radiate as the electron beam EB.

The plate-shaped inner electrode 64 is formed on the base insulator layer 62 in an inner region enclosed by the ring-shaped gate electrode 63, with a ring-shaped inner space 64*a* left therebetween. The ring-shaped outer electrode 65 is formed on the insulator layer 62 in an outer region which surrounds the ring-shaped gate electrode 63, with a ring-shaped outer space 65*a* left therebetween.

The base insulator layer 62 has a ring-shaped inner groove 62*g* and a ring-shaped outer groove 62*b* which align with the ring-shaped inner space 64*a* and the ring-shaped outer space 65*a*, respectively. The ring-shaped inner groove 62*g* extends a distance for surface insulation between the ring-shaped gate electrode 63 and the plateshaped inner electrode 64, to prevent a voltage from lowering due to contaminant, contaminated particles, or the like. Likewise, the ring-shaped outer groove 62*b* extends for a distance, providing surface insulation between the ring-shaped gate electrode 63 and the ring-shaped outer electrode 65 to prevent a voltage from lowering due to contaminant, contaminated particles, or the like. Instead of forming the ring-shaped inner groove 62*g* and the ring-shaped outer groove 62*b* in the base insulator layer 62, either a ring-shaped inner hole and a ring-shaped outer hole may be formed in the base insulator layer 62, or the ring-shaped inner space 64*a* and the ring-shaped outer space 65*a* may be filled with a ring-shaped inner insulator and a ring-shaped outer insulator, respectively.

The voltage supplying unit 90 comprises first through fifth DC power sources 91, 92, 93, 94, and 95 which are connected to each other on the basis of the substrate potential in the conductive cold-cathode substrate 61. The first DC power source 91 supplies the plate-shaped inner electrode 64 with an inner-electrode voltage $E_I$. The second DC power source 92 supplies the ring-shaped outer electrode 65 with an outer-electrode voltage $E_O$. The third DC power source 93 supplies the ring-shaped gate electrode 63 with a gate voltage $V_G$. The fourth DC power source 94 supplies the Wehnelt electrode 70 with a Wehnelt voltage $E_W$. The fifth DC power source 95 supplies the anode 80 with an anode voltage $E_A$.

In order to make the cold-cathode electron gun operate, the ring-shaped gate electrode 63 is supplied with the gate voltage $V_G$ of about 50 volts to make the tip of each conical emitter 66 emit electrons. In addition, the plane inner electrode 64 and the ring-shaped outer electrode 65 are supplied the inner-electrode voltage $E_I$ and the outer-electrode voltage $E_O$, respectively, so as to satisfy voltage conditions which are represented by the following formulas:

$$V_G > E_I,$$

and $$V_G > E_O.$$

That is, the gate voltage $V_G$ is higher than the inner-electrode voltage $E_I$ and the gate voltage $V_G$ is higher than the outer-electrode voltage $E_O$. Furthermore, the anode 80 is supplied with the anode voltage $E_A$ in a range between 1 kV and 10 kV, according to the particular application of the microwave tube.

Emitted from the tip of each conical emitter 66, the electrons are classified as central electrons or peripheral electrons. The central electrons are emitted in the forward direction perpendicular to the principal surface 61*a* of the conductive cold-cathode substrate 61, while each peripheral electron has a speed component in a direction in parallel with the principal surface 61*a* of the conductive cold-cathode substrate 61.

The central electrons in the vicinity of the field-emission cold cathode 60 are bent in a direction of the central axis CA on the basis of the distribution of an electric field defined by the plane inner electrode 64, the ring-shaped outer electrode 65, and the ring-shaped gate electrode 63. The central electrons are focused to near the central axis CA. Subsequently, apart from the field-emission cold cathode 60, the electrons are mainly affected by the distribution of an electric field defined by the Wehnelt electrode 70 and are further focused nearer to the central axis CA in the vicinity of the anode 80 as the electron beam EB.

Inasmuch as the ring-shaped gate electrode 63 is put between the plate-shaped inner electrode 64 and the ring-shaped outer electrode 65, supplied with the inner-electrode voltage $E_I$ and the outer-electrode voltage $E_O$, respectively, (both of which are lower than the gate voltage $E_G$) the peripheral electrons in the vicinity of the field-emission cold cathode 60 are bent in the travel direction of the central electrons because of the distribution of the electric field defined by the plate-shaped inner electrode 64, the ring-shaped outer electrode 65, and the ring-shaped gate electrode 63. The peripheral electrons in the vicinity of the field-emission cold cathode 60 pass through on orbital paths near the central electrons, and are accelerated by an electric field defined by the anode 80.

In the manner as described above, the peripheral electrons are focused in the direction of the central electrons while the central electrons are focused toward the central axis CA of the electron beam EB.

Each conical emitter 66 is made of a refractory metal such as tungsten or molybdenum. The ring-shaped gate electrode 63 is made of a metal such as tungsten, molybdenum, niobium, or tungsten suicide or metal compound. The insulator layer 62 has a single or composite layer structure made of silicon oxide or silicon nitride. Each gate hole 63*a* in the ring-shaped gate electrode 63 has a diameter of about 1 μm. Each conical emitter 66 has a height of about 0.5 to 1 μm. The base insulator layer 62 has a thickness of about 0.4 to 0.8 μm. The ring-shaped gate electrode 63 has a thickness of about 0.2 μm.

Such a field-emission cold cathode 60 is generally fabricated by a process as disclosed in the abovementioned article contributed by C. A. Spindt to Journal of Applied Physics, Vol. 39, No. 7 (June 1968), pages 3504–3505. After the gate holes 63*a* and the insulator holes 62*a* are formed in the ring-shaped gate electrode 63 and the base insulator layer 62, a selectively removable film is deposited at grazing incidence to the surface of the ring-shaped gate electrode 63 while the substrate 61 is rotated uniformly about the central axis CA. Subsequently, emitter material is deposited from directly over the substrate 61.

Inasmuch as the electrons in the vicinity of the field-emission cold cathode 60 have low speed, they are strongly influenced by an external electric field. In the abovementioned first embodiment, the configuration of the electrons in the vicinity of the field-emission cold cathode 60 is controlled by the plate-shaped inner electrode 64 and the ring-shaped outer electrode 65, which can form an exact electric field pattern on the field-emission cold cathode 60. As a result, it is possible to control the electron beam EB with high-precision and to form an electron beam EB with low ripple. In addition, the electrons, emitted from a ring-shaped electron emission region and having a ring-shaped cross section, travel pursuant to the distribution of electric potential, formed by the plate-shaped inner electrode 64 and the ring-shaped outer electrode 65 having an electric potential lower than the ring-shaped gate electrode 63, so as to hold down the electrons in both sides. Accordingly, a lateral velocity component of the electrons is restrained.

In addition, it is possible to change focusing conditions by changing the voltage relation between the plate-shaped inner electrode 64 and the ring-shaped outer electrode 65. As a result, it is possible to easily reorient the electron beams EB at an optimum focusing state, although the amount of current in the electron beams EB is changed by changing the gate voltage $E_G$.

Figure 13:
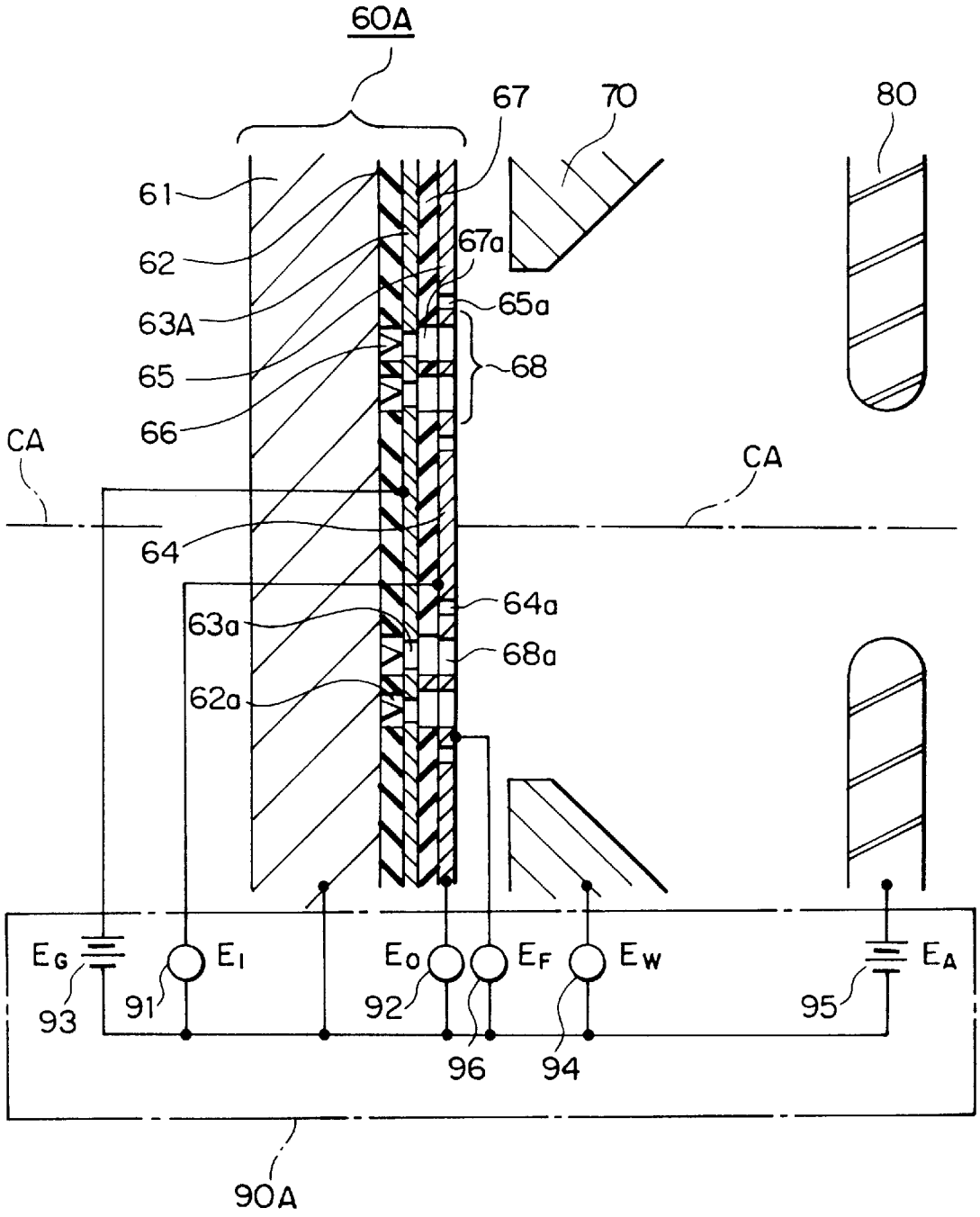
FIG. 13 is a schematic longitudinal sectional view showing a cold-cathode electron gun according to a second embodiment of the invention.

Referring to FIG. 13, a cold-cathode electron gun according to a second embodiment of the invention will be described. FIG. 13 is a schematic longitudinal sectional view showing the structure of the cold-cathode electron gun. The illustrated cold-cathode electron gun is similar in structure to that illustrated in FIG. 11, except that the field-emission cold cathode and the voltage supplying unit are modified to be different from those in conjunction with FIG. 11. The field-emission cold cathode and the voltage supplying unit are therefore depicted at 60A and 90A, respectively.

The field-emission cold cathode 60A is similar in structure to the field-emission cold cathode 60 illustrated in FIG. 11 except that the ring-shaped gate electrode 63 is modified to be a plate-shaped gate electrode 63A, and the field-emission cold cathode 60A further comprises an upper insulator layer 67 and a ring-shaped focusing electrode 68.

The upper insulator layer 67 is formed on the plate-shaped gate electrode 63A. The upper insulator layer 67 has a plurality of upper-insulator holes 67*a* which align with the respective base-insulator holes 62*a* through the respective gate holes 63*a*.

The ring-shaped focusing electrode 68 is formed on the upper insulator layer 67 in a ring-shaped focusing region opposing the ring-shaped emitter region via the upper insulator layer 67 and the gate electrode 63A. The ring-shaped focusing electrode 68 has a focusing center concentric with the central axis CA. The ring-shaped focusing electrode 68 has a plurality of focusing holes 68*a* which align with the respective base-insulator holes 62*a* through the upper-insulator holes 67*a* and the respective gate holes 63*a*.

The plate-shaped inner electrode 64 is formed on the upper insulator layer 67 in the inner region enclosed by the ring-shaped focusing electrode 68, with the ring-shaped inner space 64*a* left therebetween. The ring-shaped outer electrode 65 is formed on the upper insulator layer 67 in the outer region which surrounds the ring-shaped focusing electrode 68, with the ring-shaped outer space 65*a* left therebetween.

The voltage supplying unit 90A is similar in structure to the voltage supplying unit 90 illustrated in FIG. 11, except that the voltage supplying unit 90A further comprises a sixth DC power source 96. The sixth DC power source 96 supplies the ring-shaped focusing electrode 68 with a focusing voltage $E_F$.

The ring-shaped gate electrode 63A is supplied with a gate voltage $V_G$ of about 50 volts. The gate voltage $V_G$ may have a voltage slightly higher than 50 volts because the emission current decreases by being affected by the focusing voltage $E_F$ supplied with the ring-shaped focusing electrode 68. The ring-shaped focusing electrode 68 is supplied with a focusing voltage $E_F$ of about 10 volts. In addition, the plate-shaped inner electrode 64 and the ring-shaped outer electrode 65 are supplied an inner-electrode voltage $E_I$ and an outer-electrode voltage $E_O$, respectively, so as to satisfy voltage conditions represented by the following formulas:

$$V_F > E_I,$$

and $$V_F > E_O.$$

That is, the focusing voltage $E_F$ is higher than the inner-electrode voltage $E_I$ and the focusing voltage $E_F$ is higher than the outer-electrode voltage $E_O$. The focusing voltage $E_F$, the inner-electrode voltage $E_I$, and the outer-electrode voltage $E_O$ may be negative voltages depending on the design of the field-emission cold cathode 60A.

Emitted from the tip of each conical emitter 66, the peripheral electrons first receive the focusing action by the ring-shaped focusing electrode 68 so that the lateral velocity component is restrained. Subsequently, in a manner similar to the first embodiment, the peripheral electrons receive focusing action by an electric field defined by the plate-shaped inner electrode 64 and the ring-shaped outer electrode 65, between which the focusing electrode 68 is placed so that the lateral velocity component is restrained. Thereafter, the peripheral electrons receive focusing action by the distribution of an electric field defined by the plate-shaped inner electrode 64, the ring-shaped outer electrode 65, the Wehnelt electrode 70, and the anode 80.

With this structure, the peripheral electrons receive stronger focusing action in comparison with the above-mentioned first embodiment illustrated in FIG. 11.

Figure 14:
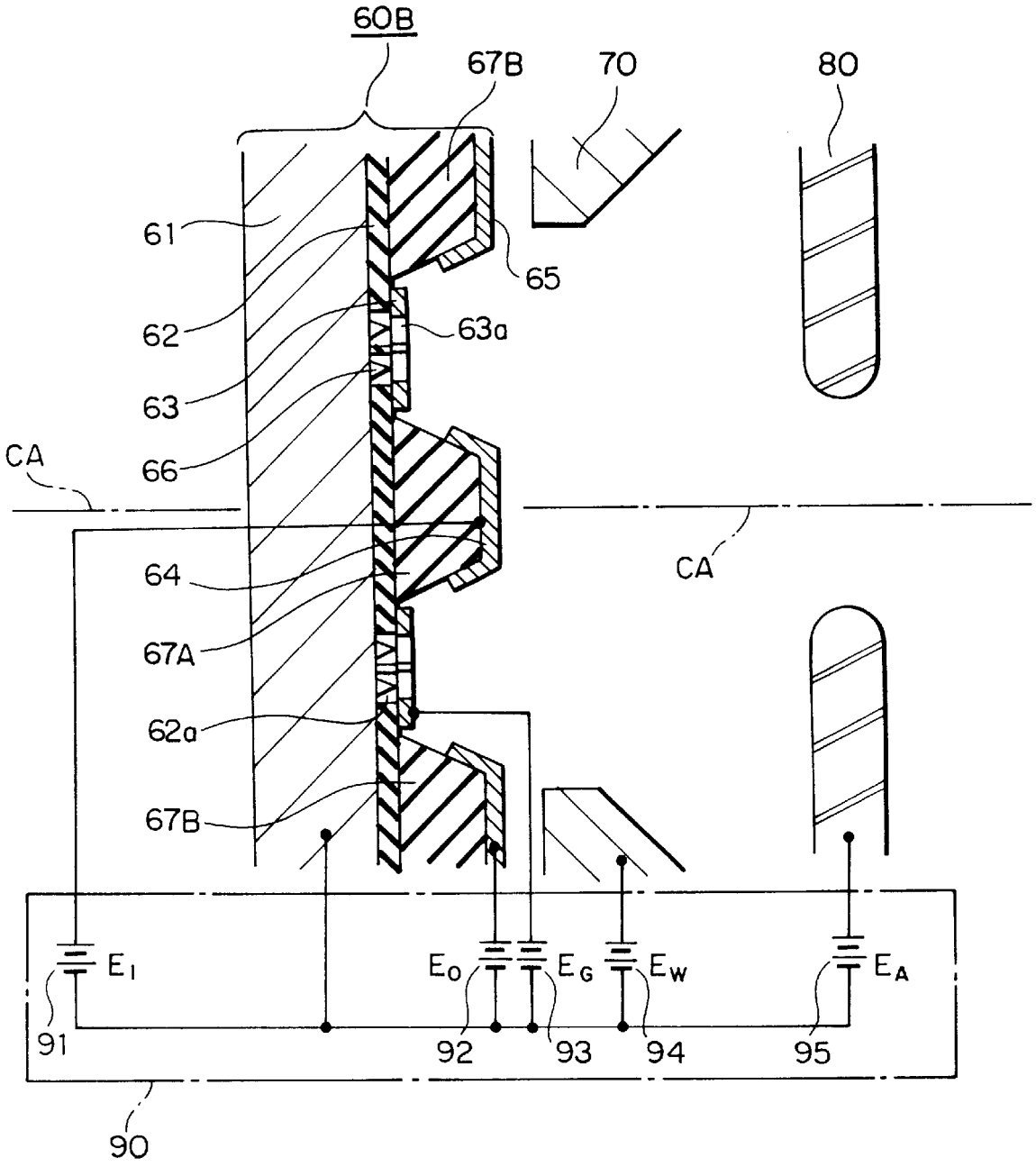
FIG. 14 is a schematic longitudinal sectional view showing a cold-cathode electron gun according to a third embodiment of the invention.

Referring to FIG. 14, a cold-cathode electron gun according to a third embodiment of this invention will be described. FIG. 14 is a schematic longitudinal sectional view showing the structure of the cold-cathode electron gun. The illustrated cold-cathode electron gun is similar in structure to that illustrated in FIG. 11, except that the field-emission cold cathode is modified to be different from that in conjunction with FIG. 11. This field-emission cold cathode is depicted at 60B.

The field-emission cold cathode 60B is similar in structure to the field-emission cold cathode 60 illustrated in FIG. 11, except that the field-emission cold cathode 60B further comprises a plate-shaped upper inner insulator layer 67A and a ring-shaped upper outer insulator layer 67B.

The plate-shaped upper inner insulator layer 67A is formed on the base insulator layer 62 in the inner region enclosed by the ring-shaped gate electrode 63. The plate-shaped inner electrode 64 is formed on the plate-shaped upper inner insulator 67A. The ring-shaped upper outer insulator layer 67B is formed on the base insulator layer 62 in the outer region surrounding the ring-shaped gate electrode 63. The ring-shaped outer electrode 65 is formed on the ring-shaped upper outer insulator layer 67B.

With this structure, electric potentials on the plate-shaped inner electrode 64 and the ring-shaped outer outer electrode 65 can have an effect on formation of an electric field, for a distance apart from the field-emission cold cathode 60B along the central axis CA, in comparison with the above-mentioned first embodiment. As a result, it is possible to form a stronger electrostatic lens. Accordingly, the emitted electrons receive stronger focusing action.

In the above-mentioned third embodiment, the field-emission cold cathode 60B may comprise either the plate-shaped upper inner insulator layer 67A or the ring-shaped upper outer insulator layer 67B.

Figure 15:
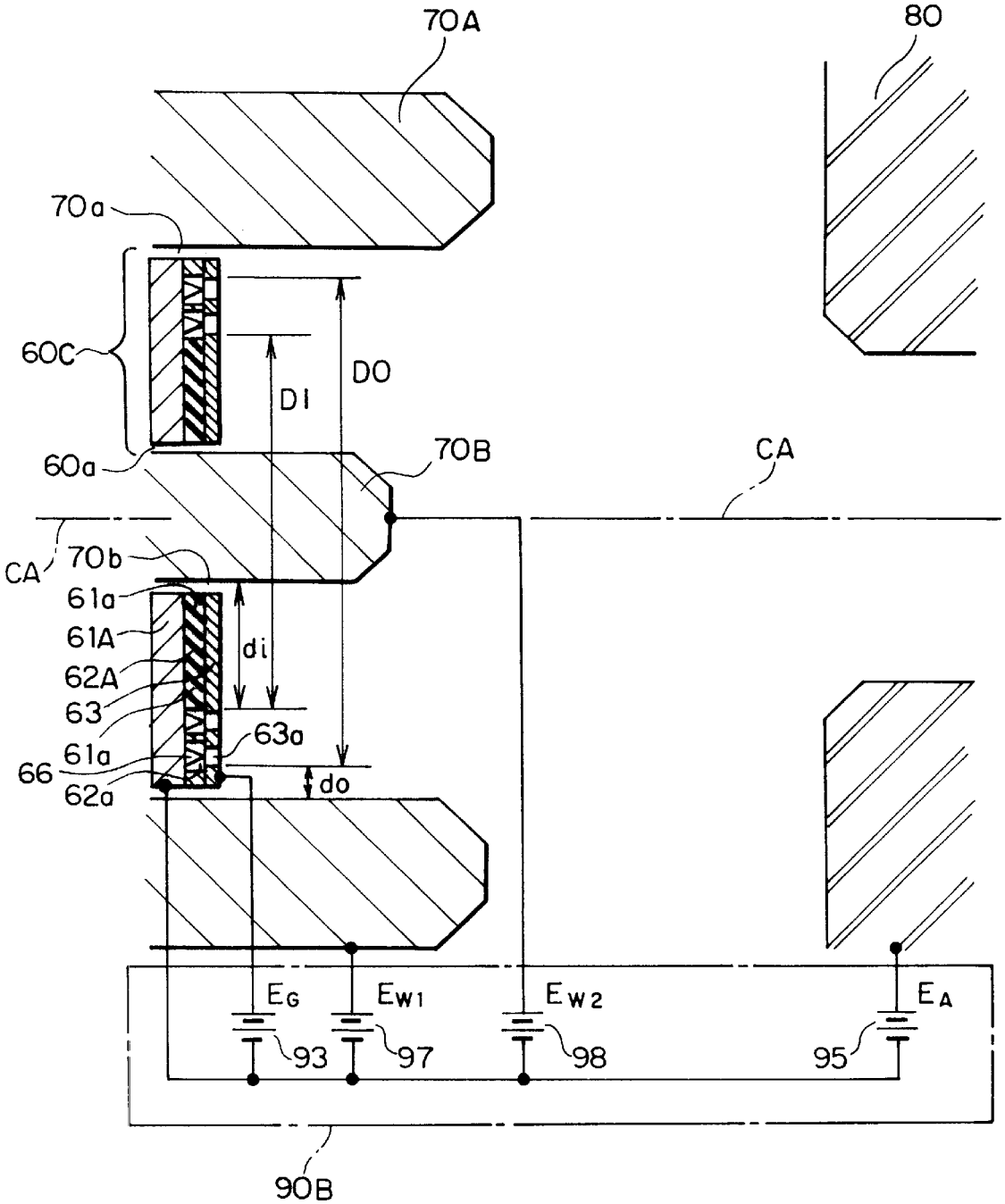
FIG. 15 is a schematic longitudinal sectional view showing a cold-cathode electron gun according to a fourth embodiment of the invention.

Referring to FIG. 15, a cold-cathode electron gun according to a fourth embodiment of the invention will be described. FIG. 15 is a schematic longitudinal sectional view showing the structure of the cold-cathode electron gun. The illustrated cold-cathode electron gun comprises a ring-shaped field-emission cold cathode 60C, a cylindrical outer Wehnelt electrode 70A, a rod-shaped inner Wehnelt electrode 70B, an anode 80, and a voltage supplying unit 90B.

The ring-shaped field-emission cold cathode 60C has a cathode opening 60*a* coaxial with the central axis CA. The ring-shaped field-emission cold cathode 60C emits electrons along the central axis CA in the forward direction to make the emitted electrons radiate as an electron beam.

The ring-shaped field-emission cold cathode 60C comprises a ring-shaped conductive cold-cathode substrate 61A, a ring-shaped base insulator layer 62A, a ring-shaped gate electrode 63, and conical emitters 66.

The ring-shaped conductive cold-cathode substrate 61A has the substrate center concentric with the central axis CA. The ring-shaped conductive cold-cathode substrate 61A has the principal surface 61*a* perpendicular to the central axis CA. The ring-shaped conductive cold-cathode substrate 61A is supplied with the substrate potential from the voltage supplying unit 90B.

The conical emitters 66 are formed on the principal surface 61*a* of the ring-shaped conductive cold-cathode substrate 61A in the ring-shaped emitter region around the substrate center. The ring-shaped emitter region has an inside diameter $D_I$ and an outside diameter $D_O$ and serves as an electron emission region. Each conical emitter 66 has a tip from which electrons emit in the forward direction.

The ring-shaped base insulator layer 62A is formed on the principal surface 61*a* of the ring-shaped conductive cold-cathode substrate 61A. The ring-shaped base insulator layer 62A has base insulator holes 62*a* surrounding the respective conical emitters with spacers left therebetween.

The ring-shaped gate electrode 63 is formed on the ring-shaped base insulator layer 62A. The ring-shaped gate electrode 63 has the gate center concentric with the central axis CA. The ring-shaped gate electrode 63 has the gate holes 63*a* which align with the respective base insulator holes 62*a* of the ring-shaped base insulator layer 62A so as to surround the conical emitters 66. The ring-shaped gate electrode 63 extracts the electrons from the conical emitters 66 to make the electrons radiate as the electron beam.

The cylindrical outer Wehnelt electrode 70A surrounds the ring-shaped field-emission cold cathode 60C with a ring-shaped outer space 70*a* left therebetween. The cylindrical outer Wehnelt electrode 70A extends in a forward direction from the ring-shaped field-emission cold cathode 60C. The cylindrical outer Wehnelt electrode 70A has an internal wall set apart from the electron emission region by an outer distance $d_o$.

The rod-shaped inner Wehnelt electrode 70B is surrounded by the ring-shaped field-emission cold cathode 60C, with a ring-shaped inner space 70*b* left therebetween. The rod-shaped inner Wehnelt electrode 70B extends in the forward direction from the ring-shaped field-emission cold cathode 60C. The rod-shaped inner Wehnelt electrode 70B has an external wall set apart from the electron emission region by an inner distance $d_i$.

With this structure, the rod-shaped inner Wehnelt electrode 70B has a height much higher than that of the above-mentioned plate-shaped inner electrode 64. For example, the plate-shaped inner electrode 64 illustrated in FIG. 14 has a height higher than that of the ring-shaped gate electrode 63 by merely several $\mu$m, while the rod-shaped inner Wehnelt electrode 70B has the height of 0.5 mm or more. That is, the height of the rod-shaped inner Wehnelt electrode 70B is one hundred times or more as large as the height of the plate-shaped inner electrode 64. As a result, it is possible to realize stronger focusing action using the cylindrical outer Wehnelt electrode 70A and the rod-shaped inner Wehnelt electrode 70B in comparison with the above-mentioned first through third embodiments.

The voltage supplying unit 90B comprises the third and the fifth DC power sources 93 and 95 and seventh and eighth DC power sources 97 and 98, in lieu of the first, the second, and the fourth DC power sources 91, 92, and 94. The seventh DC power source 97 supplies the cylindrical outer Wehnelt electrode 70A with an outer Wehnelt voltage $E_{W1}$ while the eighth DC power source 98 supplies the rod-shaped inner Wehnelt electrode 70B with an inner Wehnelt voltage $E_{W2}$. The outer Wehnelt voltage $E_{W1}$ and the inner Wehnelt voltage $E_{W2}$ satisfy, in relation to the gate voltage $V_G$, voltage conditions which are represented by the following formulas:

$$E_G > E_{W1},$$

and $$E_G > E_{W2}.$$

That is, the gate voltage $V_G$ is higher than the outer Wehnelt voltage $E_{W1}$ and the gate voltage $V_G$ is higher than the inner Wehnelt voltage $E_{W2}$.

In addition, the cylindrical outer Wehnelt electrode 70A has a height higher than that of the rod-shaped inner Wehnelt electrode 70B. In this event, it is possible to effectively focus the electron beam as a whole.

In the example being illustrated, the inner distance $d_i$ is longer than the outer distance $d_o$. That is:

$$d_i > d_o.$$

In other words, the electron emission region is brought near the cylindrical outer Wehnelt electrode 70A rather than the rod-shaped inner Wehnelt electrode 70B. In this event, it is possible to focus the electron beam strongly. This is because it is possible to strengthen the force of the electron beam that heads toward the central axis CA from outside.

Inasmuch as the electrons emitted from the ring-shaped electron emission region receive strong focusing action by the rod-shaped inner Wehnelt electrode 70B and the cylindrical outer Wehnelt electrode 70A, between which the ring-shaped electron emission region is placed, the electron beam is formed by a focusing condition which is different from that of the Pierce electron gun.

Figure 16:
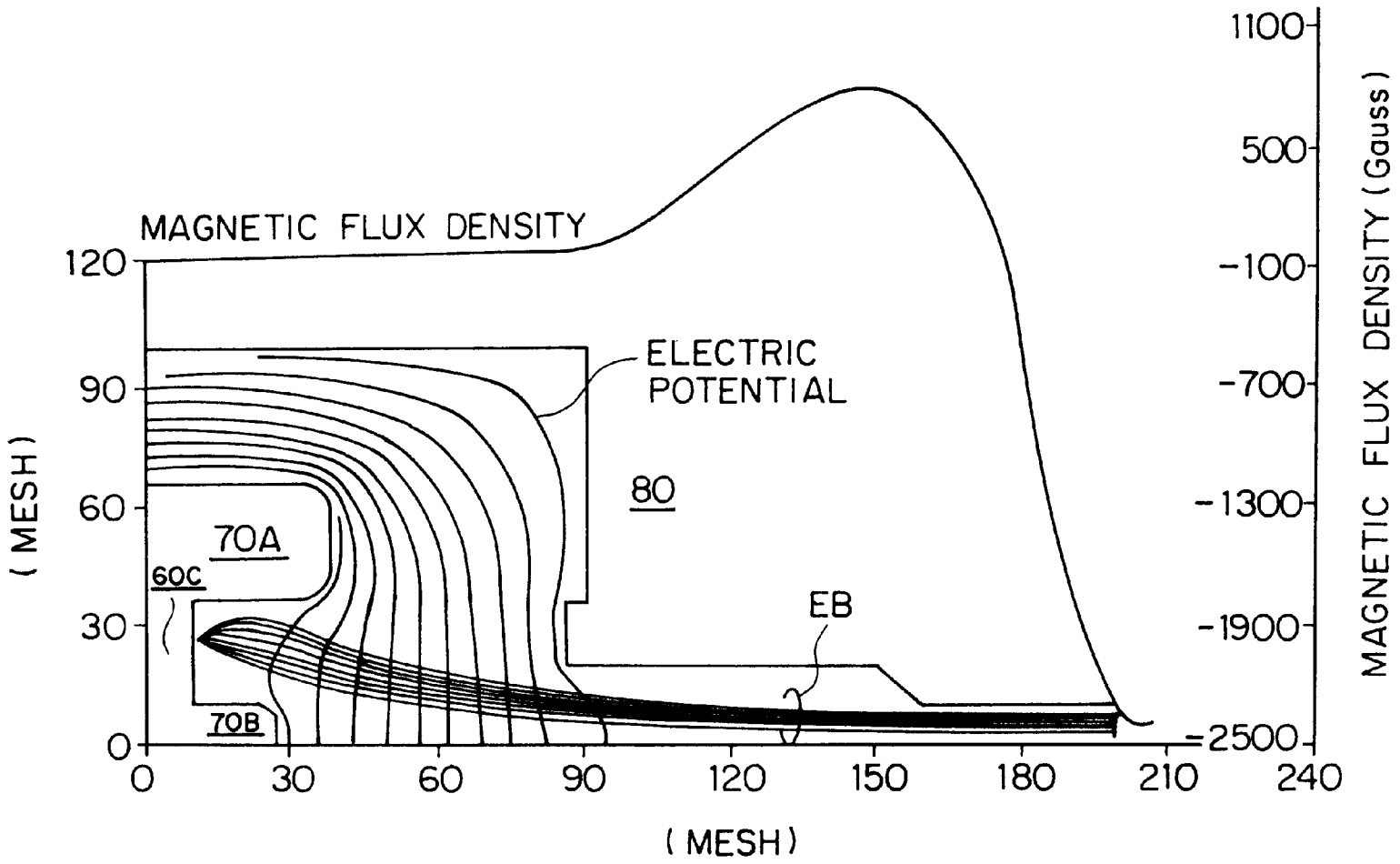
FIG. 16 shows an example of a calculated result for the trajectory of an electron beam formed by the cold-cathode electron gun illustrated in FIG. 15.

FIG. 16 shows an example of a calculated result for trajectory of the electron beam EB formed by the cold-cathode electron gun illustrated in FIG. 15. In FIG. 16, the abscissa respresents a longitudinal distance (mesh) of the cold-cathode electron gun while the ordinate represents a lateral distance (mesh) of the cold-cathode electron gun and a magnetic flux density (Gauss). In the example being illustrated, one mesh is equal to 50 $\mu$m. FIG. 16 shows not only the trajectory of the electron beam EB, but also the structure of the electrodes, distribution of electric potential, and distribution of an axial magnetic flux density. As shown in FIG. 16, the electrons emitted from the conical emitters not only have an axial speed component but also a lateral velocity component. The emitted electrons receive the focusing action by an electric field in the electron gun and by an axial magnetic flux to become a thin electron beam that can pass through a helix delay line circuit (not shown).

In order to obtain a fine electron beam having a low ripple as shown in the calculated result for the trajectory of the electron beam EB, it is necessary to satisfy the following relationship between the inside diameter $D_I$ and the outside diameter $D_O$ of the ring-shaped emitter region:

$$D_I/D_O \geqq 0.8.$$

In addition, the structure of an actual microwave tube and the design aspects of a periodic magnet used for focusing the electron beam must be taken into consideration. It is assumed that the electron beam in a helix slow-wave circuit such as a helix delay line circuit has a diameter of $D_b$. It can be shown that it is preferable to set $D_o/D_b$ for about 4.5.

In the above-mentioned fourth embodiment, the ring-shaped field-emission cold cathode 60C may further comprise a ring-shaped focusing electrode deposited on the ring-shaped gate electrode 63 through a ring-shaped upper insulator layer.

Figure 17:
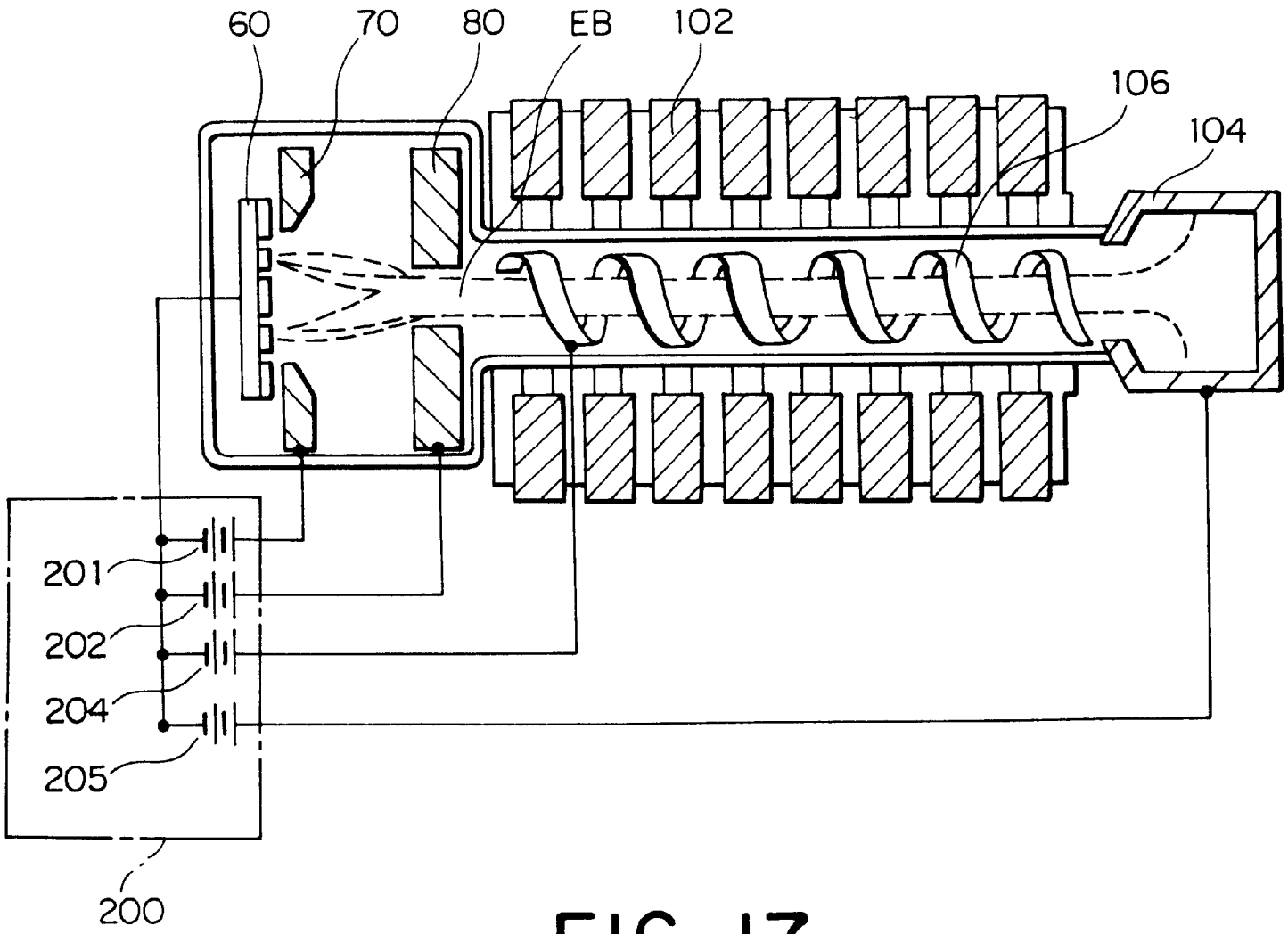
FIG. 17 is a cross-sectional view of a microwave tube including the cold-cathode electron gun illustrated in FIG. 11.

FIG. 17 is a cross-sectional view of a microwave tube containing the cold-cathode electron gun illustrated in FIG. 11. The illustrated microwave tube is a traveling-wave tube (TWT). In the manner which is described above in conjunction with FIG. 11, the cold-cathode electron gun comprises the field-emission cold cathode 60, the Wehnelt electrode 70, and the anode 80. The microwave tube further comprises a beam focusing magnet 102, a collector 104, a helix slow-wave circuit 106, and a voltage supplying unit 200. The illustrated beam focusing magnet 102 is a periodic permanent magnet. The illustrated helix slow-wave circuit 106 has an internal diameter of about 1 mm or less.

The electrons emitted from the field-emission cold cathode 60 are focused by an electrostatic field and by a magnetic field, created by the cold-cathode electron gun and by the beam focusing magnet 102, respectively, to form the electron beam EB having a predetermined shape. The electron beam EB passes through the helix slow-wave circuit 106 to be caught by the collector 104. The helix slow-wave circuit 106 has an input terminal which is supplied with an input radio frequency (RF) signal. The input RF signal forms an electron beam EB with density modulation. The density-modulated electron beam EB induces an RF signal in the helix slow-wave circuit 106 by interaction with the helix slow-wave circuit 106 while passing through the helix slow-wave circuit 106, which amplifies the RF signal. The amplified RF signal is an output RF signal from an output terminal of the helix slow-wave circuit 106.

The voltage supplying unit 200 comprises first through fourth DC power sources 201, 202, 203, and 204. The first DC power source 201 supplies the Wehnelt electrode 70 with the Wehnelt voltage. The second DC power source 202 supplies the anode 80 with the anode voltage. The third DC power source 203 supplies the helix slow-wave circuit 106 with a helix voltage. The fourth DC power source 204 supplies the collector 104 with a collector voltage. The first and the second DC power sources 201 and 202 correspond to the fourth and the fifth DC power sources 94 and 95 illustrated in FIG. 11, respectively. In FIG. 17, the first through the third DC power sources 91 to 93 shown in FIG. 11 are omitted.

With this structure, because the electron beam EB has low ripple, it is possible to strengthen the interaction between the helix slow-wave circuit 106 and the electron beam EB. As a result, it is possible to raise the gain per unit length of the helical slow-wave circuit 106 and therefore to drastically shorten the total length of the helix slow-wave circuit 106, resulting in substantial miniaturization of the traveling-wave tube (TWT). In addition, because it is possible to form an electron beam EB having a high current density, a traveling-wave tube (TWT) having a high RF-DC conversion efficiency can also be formed.

In general, because gas molecules in a tub are ionized into positive ions by collisions with electrons, there is a possibility of the cathode being damaged by the impact of the positive ions on the cathode.

It is assumed that the anode 80 is supplied with the highest electric potential. In this event, positive ions generated in the helix slow-wave circuit 106 and in the collector 104 do not arrive at the field-emission cold cathode 60. This is because such positive ions cannot climb over a pile that is the electric potential formed by the anode 80. Positive ions generated in the cold-cathode electron gun between the field-emission cold cathode 60 and the anode 80, however, do collide with the field-emission cold cathode 60.

It is assumed that the helix slow-wave circuit 106 is supplied with the highest electric potential. Positive ions generated in the helix slow-wave circuit 106 are trapped in the vicinity of the central axis CA of the helix slow-wave circuit 106. A part of positive ions arriving at the field-emission cold cathode 60 is accelerated by a potential difference between the helix slow-wave circuit 106 and the field-emission cold cathode 60 and collides with a central portion of the field-emission cold cathode 60. However, in this event, there is no fear of reliability being affected. This is because the emitters affected by ion collision are not formed on the central portion of the field-emission cold cathode 60.

Although a helical slow-wave circuit is used as the slow-wave structure 106 in FIG. 17, the helix slow-wave circuit may be a coupling cavity, a ring loop, or the like. In addition, the field-emission cold cathodes according to this invention may be applicable to other structures, such as klystrons or gyrotrons.

In addition, it is clear that the field-emission cold cathodes disclosed by this invention may be applicable to a Gray type structure, wherein emitters are formed by etching of a semiconductor substrate, or to a mold type structure, wherein emitters are formed by depositing an electron emission layer in a minute mold.

What is claimed is:

1. A field-emission cold cathode for use in an electron gun to radiate an electron beam therefrom along a central axis in a forward direction, said field-emission cold cathode comprising:

a conductive cold-cathode substrate having a substrate center concentric with said central axis and having a principal surface perpendicular to said central axis, said conductive cold-cathode substrate being supplied with a substrate potential;

a plurality of conical emitters formed on said principal surface in a ring-shaped emitter region around said substrate center, each conical emitter having a tip from which electrons emit in the forward direction;

a base insulator layer formed on said principal surface of said cold-cathode substrate, said base insulator layer having a plurality of base-insulator holes surrounding said respective conical emitters with spaces left therebetween;

a ring-shaped gate electrode formed on said base insulator layer in a ring-shaped gate region facingly opposed to said ring-shaped emitter region through said base insulator layer, said ring-shaped gate electrode having a gate center concentric with said central axis and having a plurality of gate holes which are aligned with said respective base insulator holes so as to surround said conical emitters, said ring-shaped gate electrode for extracting electrons emitted from said conical emitters to make the electrons radiate as an electron beam;

a plate-shaped inner electrode formed on said base insulator layer in an inner region enclosed by said ring-shaped gate electrode with a ring-shaped inner space left therebetween;

a ring-shaped outer electrode formed on said base insulator layer in an outer region surrounding said ring-shaped gate electrode with a ring-shaped outer space left therebetween; and voltage supplying means for supplying said ring-shaped gate electrode, said plate-shaped inner electrode, and said ring-shaped outer electrode with a gate voltage, an inner-electrode voltage, and an outer-electrode voltage, respectively, referenced to the substrate potential of said conductive cold-cathode substrate, said gate voltage being higher than said inner-electrode voltage and said gate voltage being higher than said outer-electrode voltage.

2. A field-emission cold cathode as claimed in claim 1, further comprising a plate-shaped upper inner insulator layer formed on said base insulator layer in said inner region, said plate-shaped inner electrode being formed on said plate-shaped upper inner insulator layer.

3. A field-emission cold cathode as claimed in claim 1, further comprising a ring-shaped upper outer insulator layer formed on said base insulator layer in said outer region, said ring-shaped outer electrode being formed on said ring-shaped upper outer insulator layer.

4. A field-emission cold cathode as claimed in claim 1, further comprising a plate-shaped upper inner insulator layer formed on said base insulator layer in said inner region and a ring-shaped upper outer insulator layer formed on said base insulator layer in said outer region, said plate-shaped inner electrode being formed on said plate-shaped upper inner insulator layer, said ring-shaped outer electrode being formed on said ring-shaped upper outer insulator layer.

5. A field-emission cold cathode for use in an electron gun for radiating an electron beam therefrom along a central axis in a forward direction, said field-emission cold cathode comprising:

a conductive cold-cathode substrate having a substrate center concentric with said central axis and a principal surface perpendicular to said central axis, said conductive cold-cathode substrate supplied with a substrate potential;

a plurality of conical emitters formed on said principal surface in a ring-shaped emitter region around said substrate center, each conical emitter having a tip from which electrons emit in the forward direction;

a base insulator layer formed on said principal surface, said base insulator layer having a plurality of base-insulator holes surrounding respective said conical emitters with spaces left therebetween;

a gate electrode formed on said base insulator layer, said gate electrode having a gate center concentric with said central axis and having a plurality of gate holes which are aligned with respective said base-insulator holes so as to surround said conical emitters, said gate electrode for extracting electrons emitted from said conical emitters to make the electrons radiate as an electron beam;

an upper insulator layer formed on said gate electrode, said upper insulator layer having a plurality of upper-insulator holes which are aligned with the base-insulator holes via the gate holes;

a ring-shaped focusing electrode formed on said upper insulator layer in a ring-shaped focusing region facingly opposed to the ring-shaped emitter region through said upper insulator layer and said gate electrode, said ring-shaped focusing electrode having a focusing center concentric with said central axis and having a plurality of focusing holes which are aligned with the respective said gate holes via the upper-insulator holes;

a plate-shaped inner electrode formed on said upper insulator layer in an inner region enclosed by said ring-shaped focusing electrode with a ring-shaped inner space left therebetween;

a ring-shaped outer electrode formed on said upper insulator layer in an outer region surrounding said ring-shaped focusing electrode with a ring-shaped outer space left therebetween; and voltage supplying means for supplying said ring-shaped focusing electrode, said plate-shaped inner electrode, and said ring-shaped outer electrode with a focusing voltage, an inner-electrode voltage, and an outer-electrode voltage, respectively, referenced to the substrate potential of said conductive cold-cathode substrate, said focusing voltage being higher than said inner-electrode voltage and said focusing voltage being higher than said outer-electrode voltage.

6. A cold-cathode electron gun for radiating an electron beam therefrom along a central axis in a forward direction, comprising:

a ring-shaped cold cathode having a cathode opening coaxial with said central axis, said ring-shaped cold cathode for emitting electrons along the central axis to make said electrons radiate as said electron beam, said ring-shaped cold cathode including a conductive cathode substrate supplied with a substrate potential, said ring-shaped cold cathode having a ring-shaped gate electrode that includes a ring-shaped electron emission region, wherein said ring-shaped gate electrode is disposed opposed to said conductive cathode substrate, and wherein said ring-shaped electron emission region defines a ring-shaped area concentric to said central axis;

a cylindrical outer Wehnelt electrode surrounding said ring-shaped cold cathode with a ring-shaped outer space left thererbetween, said cylindrical outer Wehnelt electrode extending in the forward direction from said ring-shaped cold cathode;

a rod-shaped inner Wehnelt electrode surrounded by said ring-shaped cold cathode with a ring-shaped inner space left therebetween, said rod-shaper inner Wehnelt electrode extending in the forward direction from said ring-shaped cold cathode; and voltage supplying means for supplying said ring-shaped gate electrode, said cylindrical outer Wehnelt electrode, and said rod-shaped inner Wehnelt electrode with a gate voltage, an outer Wehnelt voltage, and an inner Wehnelt voltage, respectively, referenced to said substrate potential, wherein said gate voltage is higher than said outer Wehnelt voltage and said gate voltage is higher than said inner Wehnelt voltage.

7. A cold-cathode electron gun as claimed in claim 6, wherein said ring-shaped electron emission region is defined by an inside diameter $D_I$ and an outside diameter $D_O$, and wherein said inside diameter $D_I$ and said outside diameter $D_O$ are satisfied by the following relationship: $D_I/D_O \geqq 0.8$.

8. A cold-cathode electrode gun as claimed in claim 6, wherein said cylindrical outer Wehnelt electrode has a height which is higher than that of said rod-shaped inner Wehnelt electrode, wherein said height is a distance along said center axis from said conductive cathode substrate.

9. A cold-cathode electrode gun as claimed in claim 6, wherein said cylindrical outer Wehnelt electrode has an internal wall which is apart from said electron emission region by an outer distance, and wherein said rod-shaped inner Wehnelt electrode has an external wall which is apart from said electron emission region by an inner distance, wherein said inner distance is longer than said outer distance.

* * * * *

UNITED STATES PATENT AND TRADEMARK OFFICE

CERTIFICATE OF CORRECTION

PATENT NO. : 5,929,557
DATED : July 27, 1999
INVENTOR(S) : Hideo MAKISHIMA and Masaaki TAKAHASHI It is certified that error appears in the above-identified patent and that said Letters Patent is hereby corrected as shown below:

Column 6, line 40, delete "7-4,501" and insert --7-14501--.

Column 6, line 41, delete "7-4,501" and insert --7-14501--.

Signed and Sealed this
Ninth Day of May, 2000

*Attest:*

*Attesting Officer*

Q. TODD DICKINSON

*Director of Patents and Trademarks*